US010358763B2

(12) United States Patent
Pessot et al.

(10) Patent No.: US 10,358,763 B2
(45) Date of Patent: Jul. 23, 2019

(54) LAUNDRY WASHING MACHINE WITH IMPROVED LEVEL SENSING DEVICE

(71) Applicant: Electrolux Appliances Aktiebolag, Stockholm (SE)

(72) Inventors: Marco Pessot, Pordenone (IT); Mauro Cinello, Codroipo (IT); Vittorio Perosa, Gruaro (IT)

(73) Assignee: Electrolux Appliances Aktiebolag (SE)

( * ) Notice: Subject to any disclaimer, the term of this patent is extended or adjusted under 35 U.S.C. 154(b) by 92 days.

(21) Appl. No.: 14/766,293

(22) PCT Filed: Feb. 12, 2014

(86) PCT No.: PCT/EP2014/052756

§ 371 (c)(1),
(2) Date: Aug. 6, 2015

(87) PCT Pub. No.: WO2014/124989

PCT Pub. Date: Aug. 21, 2014

(65) Prior Publication Data

US 2015/0368849 A1 Dec. 24, 2015

(30) Foreign Application Priority Data

Feb. 15, 2013 (EP) ..... 13155492

(51) Int. Cl.
*D06F 39/08* (2006.01)

(52) U.S. Cl.
CPC ..... *D06F 39/087* (2013.01)

(58) Field of Classification Search
CPC ..... D06F 39/087; D06F 39/02
(Continued)

(56) References Cited

U.S. PATENT DOCUMENTS 4,066,094 A * 1/1978 Stitch ..... D06F 39/083 137/387

FOREIGN PATENT DOCUMENTS

EP 1522624 A2 * 4/2005 ..... D06F 37/263
EP 2009408 A2 12/2008
(Continued)

OTHER PUBLICATIONS

International Search Report dated Apr. 3, 2014 in related International Application No. PCT/EP2014/052756.

*Primary Examiner* — Michael E Barr
*Assistant Examiner* — Tinsae B Ayalew
(74) *Attorney, Agent, or Firm* — RatnerPrestia

(57) ABSTRACT

A laundry washing machine (1) has a washing tub (3) external to a rotatable washing drum (4) adapted to receive laundry. The machine further has a level sensing device (19) having a pressure sensor (50) suitable for determining the liquid level inside the washing tub (3). The level sensing device (19) further has an air chamber (51; 151) connectable to a detection outlet (60) associated to the washing tub (3). A liquid flowing path (61) is defined between the detection outlet (60) and the air chamber (51; 151), wherein the liquid may flow between the washing tub (3) and the air chamber (51;151). In a mounted configuration, the air chamber (51; 151) is associated to the washing tub (3) and the laundry washing machine (1) is positioned in its working position, and the path (61) is shaped such that at least a section of the path, in a plane perpendicular to a flowing direction (V) of the liquid, has the upper part comprising a rectilinear portion (64*a;* 64*b;* 164*a*).

12 Claims, 8 Drawing Sheets

(58) Field of Classification Search
USPC ..... 68/17 R
See application file for complete search history.

(56) References Cited

FOREIGN PATENT DOCUMENTS

| | | | |
|---|---|---|---|
| FR | 1206373 | A | 2/1960 |
| WO | 2008107022 | A1 | 9/2008 |

* cited by examiner

LAUNDRY WASHING MACHINE WITH IMPROVED LEVEL SENSING DEVICE

The present invention concerns the field of laundry washing techniques.

In particular, the present invention refers to a laundry washing machine equipped with a level sensing device for sensing the liquid level in the machine.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing provided with a washing tub which contains a rotatable perforated drum where the laundry is placed.

A loading/unloading door ensures access to the drum.

Laundry washing machines typically comprise a water inlet circuit and a products supply unit for the introduction of water and washing/rinsing products (i.e. detergent, softener, etc.) into the tub.

Known laundry washing machines are also provided with drain liquid devices that may operate during different phases of the washing cycle in order to drain liquid from the bottom of the tub and to convey the liquid either to the outside or inside the same washing tub. In the latter case, the drain liquid device is part of a recirculation circuit.

The drain liquid devices typically drain water from the tub by means of a discharge pipe connected to the bottom of the tub.

The bottom of the washing tub typically receives a heater, usually an electrical resistance, which heats up the liquid wherein it is immersed.

The laundry washing machines of know type are also typically equipped with a level sensing device for sensing the liquid level in the machine. The liquid level detected by this device is opportunely used to correctly activate the water inlet circuit and the drain liquid device during the phases of the washing cycle.

Level sensing devices of known type comprise a pressure sensor, or pressure switch, which communicates with an air volume enclosed in an air chamber via a narrow conduit. The air chamber is typically arranged at the bottom part of the washing machine and is typically connected to the drain liquid device or directly to the bottom of the washing tub. The air chamber is connected to the drain liquid device or directly to the bottom of the washing tub in such a way that the liquid in the chamber reflects the liquid level in the machine. The air volume enclosed above the liquid in the chamber is therefore subjected to a pressure which is sensed by the pressure sensor and then translated into a measure of the liquid level in the machine.

A laundry washing machine showing an air chamber for a pressure sensor is disclosed in document WO2008107022A1.

The air chamber disclosed in such document comprises two portion: an upper portion communicating with the pressure sensor through a narrow conduit and a lower portion connected to an outlet of the washing tub.

The outlet of the washing tub comprises a cylindrically shaped collar at which a corresponding cylindrically shaped portion of the lower portion of the air chamber is inserted.

Therefore, between the washing tub and the air chamber a cylindrical liquid flowing path is defined wherein the liquid may flow.

When the liquid rises in the tub, a corresponding liquid column is also created in the air chamber. The liquid column applies a pressure to the air volume enclosed thereabove in the air chamber and inside the conduit. Said pressure is then sensed by the pressure sensor connected to the conduit.

As known, the pressure sensor starts to detect a pressure only when the liquid flowing path is completely obstructed by the liquid which flows from the washing tub towards the air chamber. If the liquid flowing path is not completely obstructed by the liquid, in fact, the air chamber pressure does not increase and remains at its normal pressure, i.e. at atmospheric pressure.

The pressure sensor, therefore, starts to detect a pressure only when the liquid inside the washing tub reaches a level at which the liquid flowing path is completely obstructed. This happens when the liquid inside the washing tub reaches a level corresponding to the upper part of the liquid flowing path, i.e. the upper part of the cylindrical liquid flowing path.

The above described known level sensing device, however, poses some drawbacks.

A first drawback posed by this known technique is constituted by the fact that the starting point of the detection for the level sensing device is not accurate. In fact, the starting point of detection occurs when the liquid inside the washing tub reaches a level corresponding to the upper part of the cylindrical liquid flowing path, which is practically constituted by the upper point of a circumference.

Therefore, even slight movements of the liquid around such starting detection level may cause intermittent detections of the liquid level by the pressure sensor.

This may determine a not stable level detection by the pressure sensor and a consequent wrong management of the washing cycle which is based on said liquid level.

Furthermore, a wrong level detection of low liquid level inside the washing tub may cause an undesired period of time during which the electric resistance is not immersed in the liquid which, in turn, may cause the burning of the electrical resistance.

The aim of the present invention is therefore solving the noted drawbacks and thus providing a laundry washing machine having an improved liquid level sensing device arrangement.

It is a first object of the invention to implement a laundry washing machine that makes it possible to increase the liquid level detection accuracy compared to machines of known type.

It is a further object of the invention to implement a laundry washing machine that makes it possible to increase reliability of the machine itself.

Another object of the present invention is to provide a laundry washing machine that lasts longer than machines of known type.

Advantages, objects, and features of the invention will be set forth in part in the description and drawings which follow and in part will become apparent to those having ordinary skill in the art upon examination of the following or may be learned from practice of the invention.

SUMMARY OF SELECTED INVENTIVE ASPECTS

Applicant has found that by providing a laundry washing machine comprising a washing tub external to a rotatable washing drum adapted to receive laundry, a water supply circuit to supply water into the washing tub, a water outlet circuit suitable for withdrawing liquid from a discharge outlet of the washing tub, a level sensing device comprising a pressure sensor suitable for determining the liquid level inside said washing tub and an air chamber connectable to a detection outlet of said washing tub, wherein a liquid flowing path is defined between said washing tub and said air chamber in which said liquid may flow between said washing tub and said air chamber, and by providing a rectilinear (or flat) portion in the upper part of said path, it is possible to obtain a laundry washing machine having a higher detection accuracy compared to machines of known type.

The present invention relates, therefore, to a laundry washing machine comprising:

- a washing tub external to a rotatable washing drum adapted to receive laundry;
- a water supply circuit to supply water into said washing tub;
- a washing/rinsing products supplier to supply washing/rinsing products into said washing tub;
- a water outlet circuit suitable for withdrawing liquid from said washing tub;
- a level sensing device comprising a pressure sensor suitable for determining the liquid level inside said washing tub, said level sensing device further comprising an air chamber connectable to a detection outlet associated to said washing tub;
- a liquid flowing path defined between said detection outlet and said air chamber wherein said liquid may flow between said washing tub and said air chamber;
- wherein in a mounted configuration, in which said air chamber is associated to said washing tub and said laundry washing machine is positioned in its working position, said path is shaped such that at least a section of said path in a plane perpendicular to a flowing direction of said liquid has the upper part comprising a rectilinear (or flat) portion.

Preferably the rectilinear (or flat) portion is arranged in such a way that, when the washing machine is positioned in its working position, e.g. positioned over a substantially horizontal surface or ground, the rectilinear (or flat) portion is substantially horizontal.

In a preferred embodiment of the invention, the section is defined in the air chamber.

Preferably, the section is defined in a lower part of the air chamber connectable to the detection outlet.

More preferably, the lower part comprises a tubular portion having at least one upper planar surface, said at least one upper planar surface defining the rectilinear (or flat) portion.

In another preferred embodiment of the invention, the lower part comprises a tubular duct comprising at least a planar rib, the planar rib defining the rectilinear (or flat) portion and furthermore the planar rib defines an upper closed space and a lower space which allows flowing of liquid.

In a different preferred embodiment of the invention, the section is defined in the washing tub.

More preferably, the section is defined in the detection outlet of the washing tub.

Advantageously, in its working position the washing machine rests on a horizontal, or substantially horizontal, floor.

Preferably, the flowing direction is a substantially horizontal direction.

In a different preferred embodiment of the invention, the section comprises a lower circular portion and a horizontal chord defining the rectilinear (or flat) portion.

In a preferred embodiment of the invention, the detection outlet is realized at a lower portion of the washing tub.

Preferably, the detection outlet is circularly shaped.

Advantageously, the pressure sensor and the air chamber are connected through a conduit.

In a preferred embodiment of the invention, the machine of the invention is a laundry washing-drying machine.

Preferably, the washing tub comprises two complementary hemi-shells reciprocally coupled.

BRIEF DESCRIPTION OF THE DRAWINGS

Further characteristics and advantages of the present invention will be highlighted in greater detail in the following detailed description of preferred embodiments of the invention, provided with reference to the enclosed drawings.

In the drawings, corresponding characteristics and/or components are identified by the same reference numbers. In said drawings.

DETAILED DESCRIPTION OF EXAMPLE EMBODIMENTS

The present invention has proved to be particularly advantageous when applied to laundry washing machines, as described below. It should in any case be underlined that the present invention is not limited to laundry washing machines.

On the contrary, the present invention can be conveniently applied to laundry washing-drying machines (i.e. laundry washing machines which can also dry laundry).

In the present description, therefore, the term "laundry washing machine" will refer to both simple laundry washing machines and laundry washing-drying machines.

Figure 1:
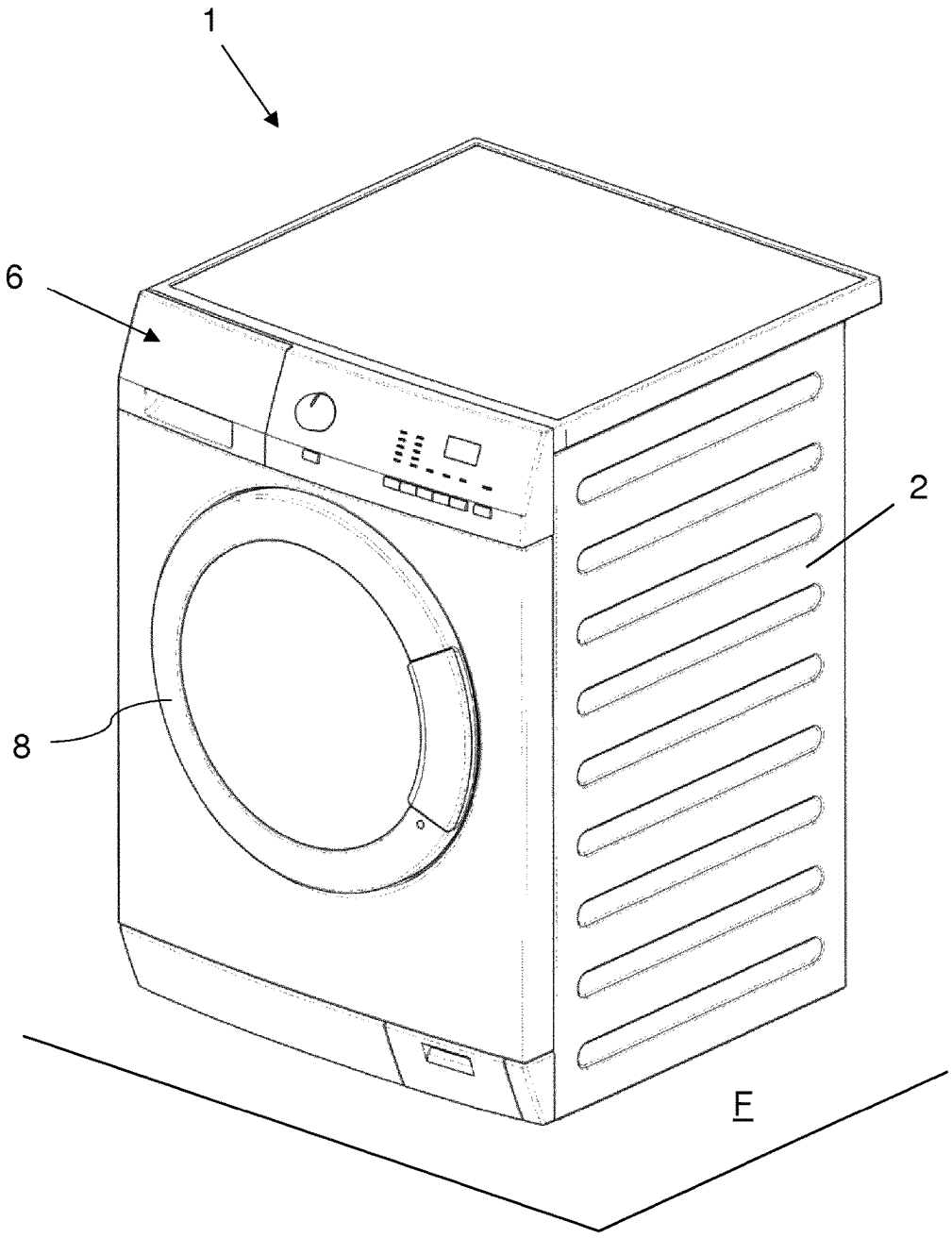
FIG. 1 shows a perspective view of a laundry washing machine according to a preferred embodiment of the invention.

FIG. 1 shows a laundry washing machine 1 according to a preferred embodiment of the invention.

The laundry washing machine 1 comprises an external casing or housing 2, in which a washing tub 3 is provided that contains a rotatable perforated drum, not illustrated in the figures, where the laundry to be treated can be loaded.

The tub 3 and the drum both preferably have a substantially cylindrical shape.

The housing 2 is provided with a loading/unloading door 8 which allows access to the washing drum.

The tub 3 is preferably suspended in a floating manner inside the housing 2, advantageously by means of a number of coil springs and shock-absorbers, not illustrated.

The drum is advantageously rotated by an electric motor, not illustrated, which preferably transmits the rotating motion to the shaft of the drum, advantageously by means of a belt/pulley system. In a different embodiment of the invention, the motor can be directly associated with the shaft of the drum.

The laundry washing machine 1 preferably comprises a water supply circuit preferably arranged in the upper part of the laundry washing machine 1 and suited to supply water into the tub 3. The water supply circuit of a laundry washing machine is well known in the art, and therefore it will not be described in detail.

The laundry washing machine 1 advantageously comprises a removable drawer 6 provided with various compartments suited to be filled with washing and/or rinsing products (i.e. detergent, softener, etc.).

The tub 3 preferably comprises two complementary hemi-shells 13 and 14 structured for being reciprocally coupled to form the tub 3. Preferably the hemi-shells 13 and 14, namely a front hemi-shell 13 and a rear hemi-shell 14, are realized separately and then fixedly connected to form the tub 3. More preferably, the hemi-shells 13 and 14 comprise a plastic material and are preferably realized by injection moulding.

The lower portion 3*a* of the tub 3 preferably comprises a seat 17 suitable for receiving a heater device 18. Preferably the seat 17 is made in a single piece with the tub 3. The heater device 18 preferably comprises an electric resistor suited to come into contact with the liquid present on the bottom of the tub 3 to heat up said liquid. Activation of the heater device 18 heats up the liquid in which it is immersed.

Advantageously, laundry washing machine 1 comprises a temperature sensor, not illustrated in the figures, for sensing the temperature of the liquid inside the tub 3. Preferably, the temperature sensor is placed in correspondence of the heater device 18, more preferably integrally made with it.

Figure 2:
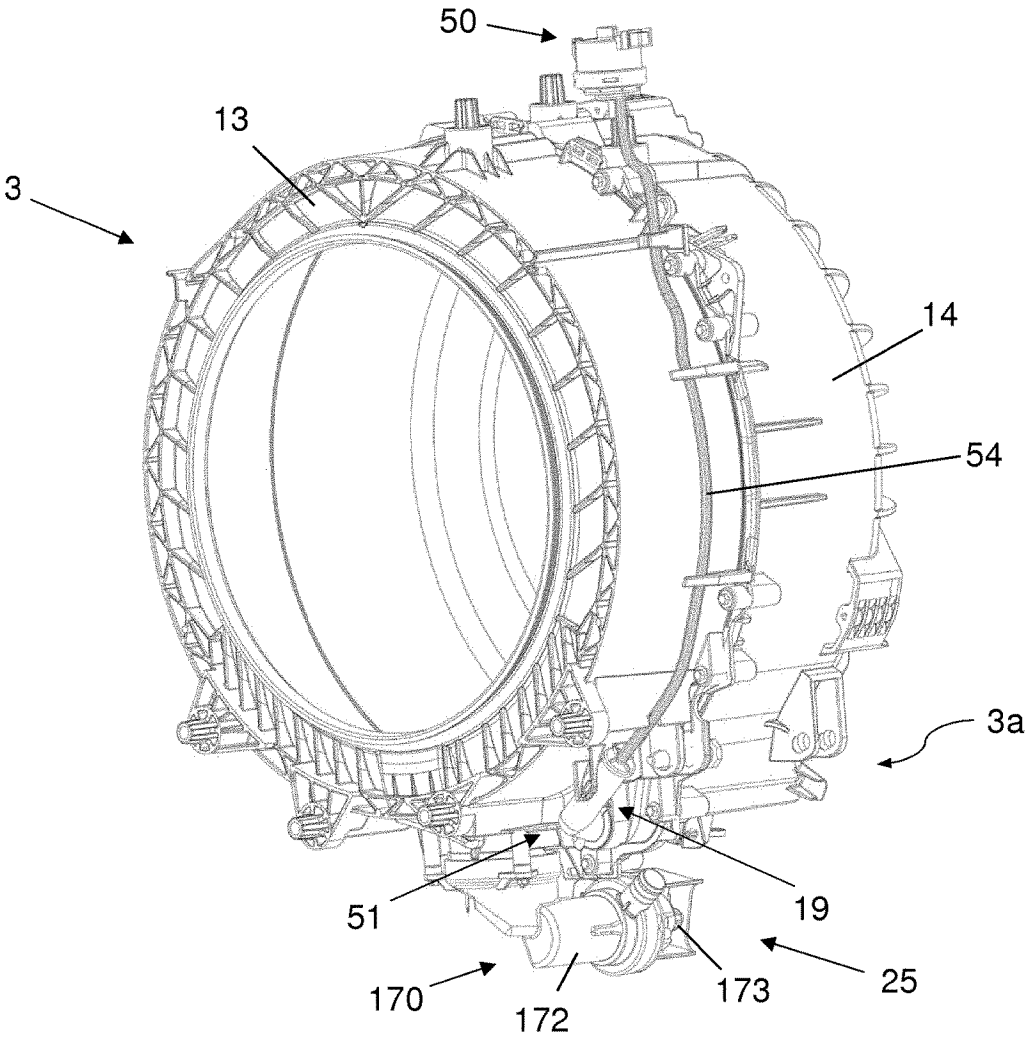
FIG. 2 shows a perspective view of some components of the laundry washing machine of FIG. 1 with the external casing removed.
Figure 3:
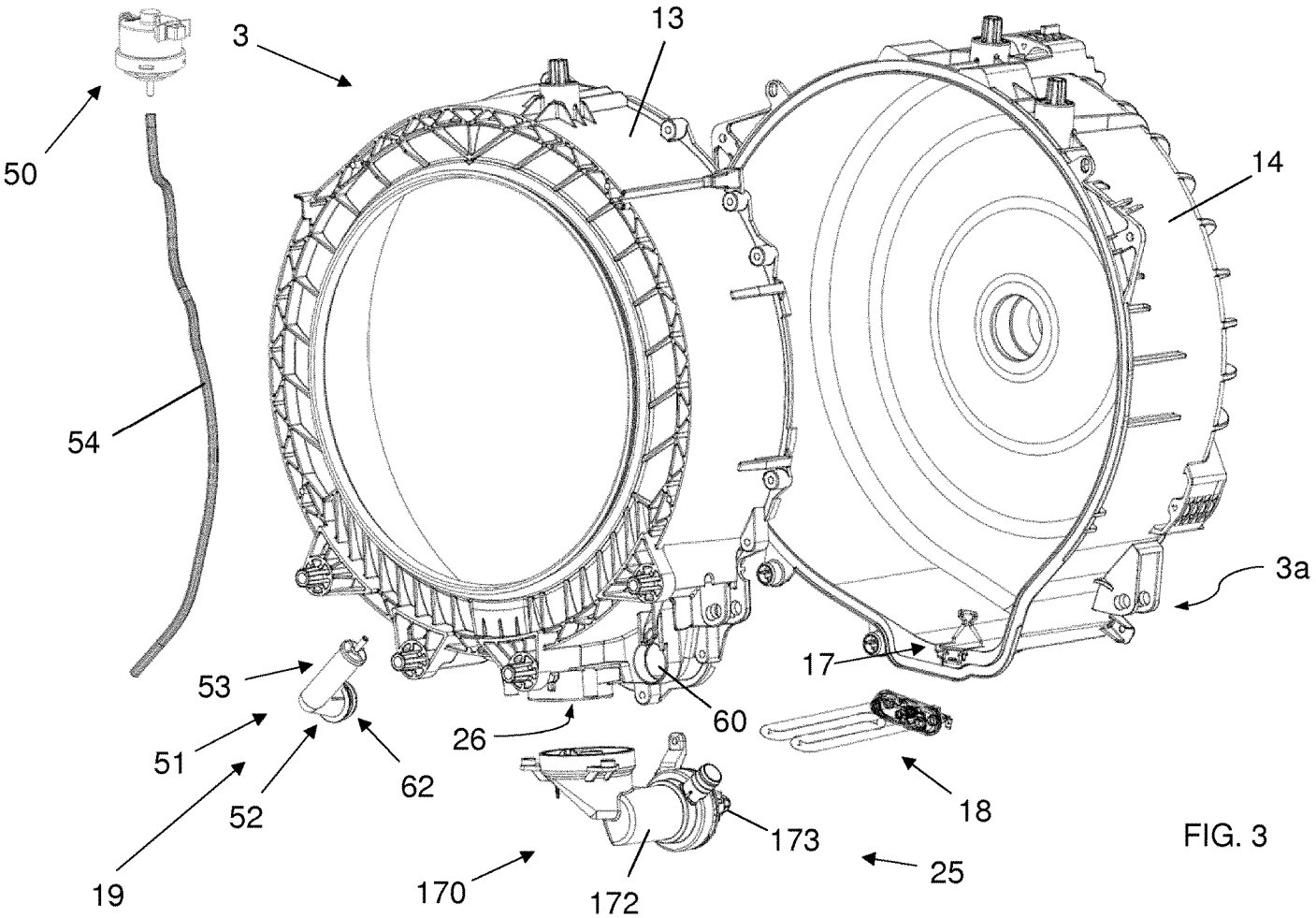
FIG. 3 shows an exploded view of FIG. 2.
Figure 5:
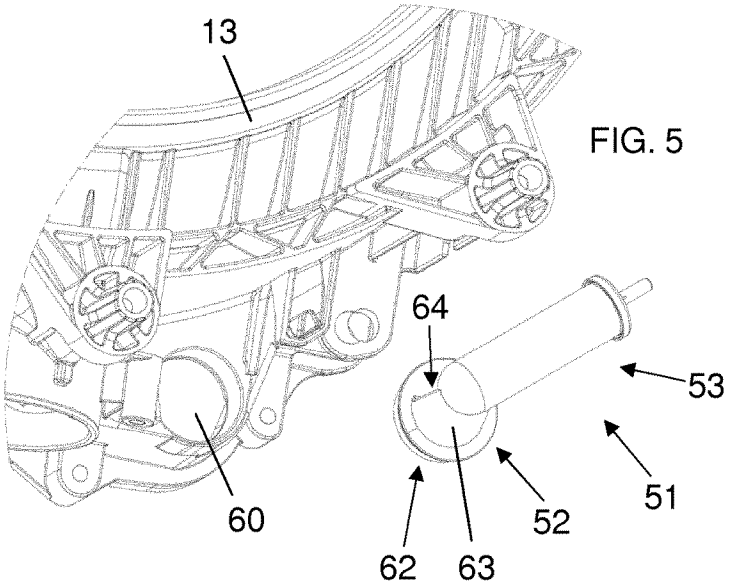
FIG. 5 shows an enlarged detail of FIG. 4.
Figure 4:
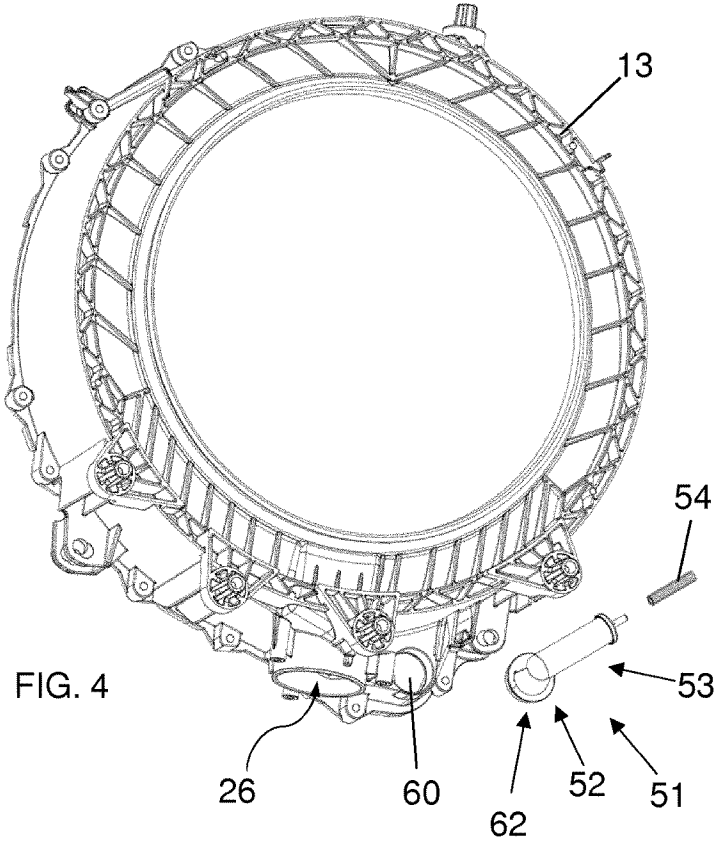
FIG. 4 shows some components of FIG. 3 from another point of view.
Figure 6:
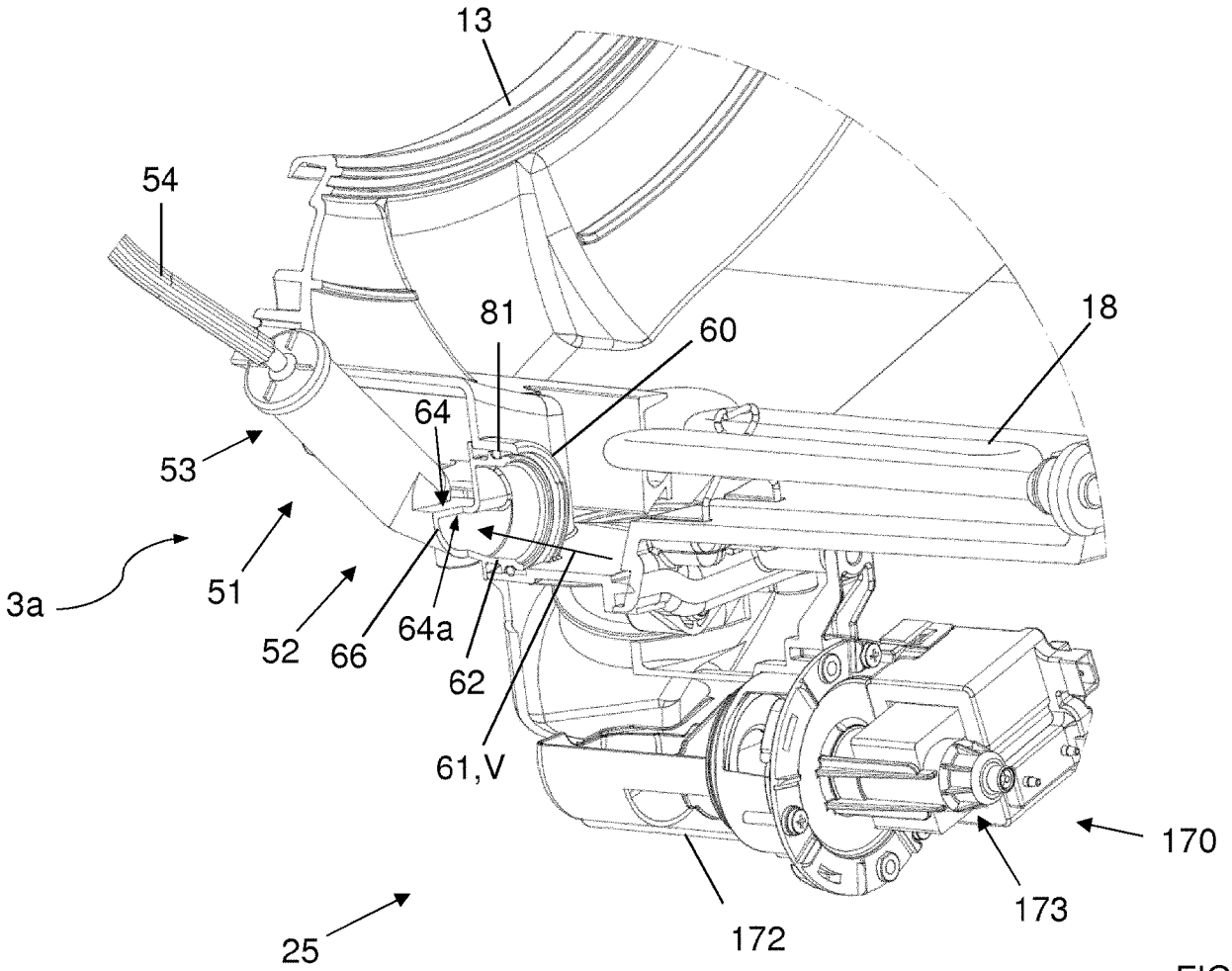
FIG. 6 shows a partial sectional view of some of the components shown in FIG. 2.
Figure 9:
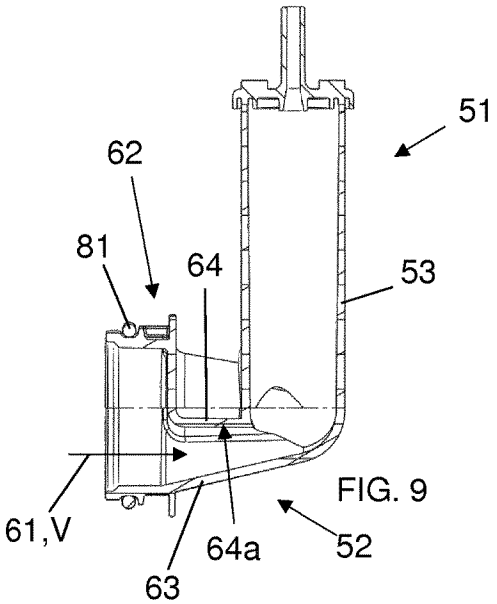
FIG. 9 shows a sectional view taken along line IX-IX of FIG. 8.

The laundry washing machine 1 advantageously comprises a water outlet circuit 25, only partially illustrated in FIGS. 2, 3 and 6, suitable for withdrawing liquid from the lower portion 3*a* of the tub 3.

The lower portion 3*a* of the tub 3 is provided with a discharge outlet 26 through which the liquid may be withdrawn from the tub 3.

In a preferred embodiment, the liquid withdrawn from the tub 3 may be conveyed either to the outside or inside the same washing tub 3. In the latter case, the water outlet circuit belongs to a recirculation circuit which preferably withdraws liquid from the the lower portion 3*a* of the tub 3 and re-admits such a liquid into another region of the tub 3, preferably into an upper region of the tub 3.

In the preferred embodiment here described, the water outlet circuit 25 preferably comprises an integrated drain pump 170 arranged below the discharge output 26.

The integrated drain pump 170 preferably comprises a duct 172 connectable to the tub 3 at the discharge outlet 26 and a draining pump 173. Activation of the draining pump 173 conveys liquid to the outside, or again inside the tub 3 if a recirculation circuit is provided.

In different embodiments, nevertheless, the water outlet circuit may be of different type. For example, the water outlet circuit may comprise a drain hose arranged below the discharge output and opportunely connected to a draining pump remotely arranged.

Advantageously, the laundry washing machine 1 comprises a level sensing device 19 suited to sense (or detect) the liquid level inside the tub 3.

The level sensing device 19 preferably comprises a pressure sensor 50, or pressure switch and an air chamber 51 enclosing an air volume.

The air chamber 51 preferably comprises a first part 52, or lower part, and a second part 53, or upper part. The air chamber 51 with its lower and upper parts 52, 53 is preferably substantially cylindrically shaped.

The air chamber 51 advantageously communicates (i.e. it is fluidly connected to) at one side with the tub 3 and on another side with the pressure sensor 50.

Preferably, the lower portion 3*a* of the tub 3 comprises an outlet 60, or detection outlet, at which the lower part 52 of the air chamber 51 is connected. More preferably, the detection outlet 60 is realized at the bottom of the front hemi-shell 13.

Between the detection outlet 60 and the air chamber 51 a liquid flowing path 61 is defined.

The liquid flowing path 61 is therefore preferably defined part in the tub 3, at said detection outlet 60, and part in said lower part 52 of the air chamber 50.

Figure 10:
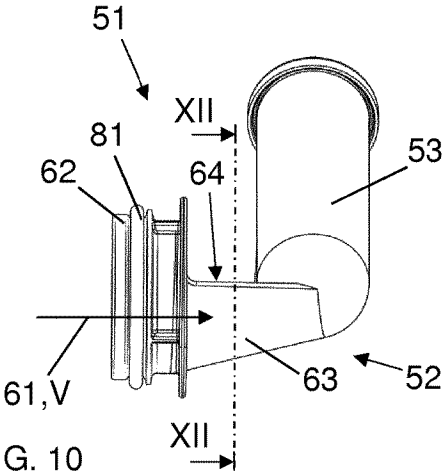
FIG. 10 shows a lateral plan view of the component shown in FIG. 7.
Figure 14:
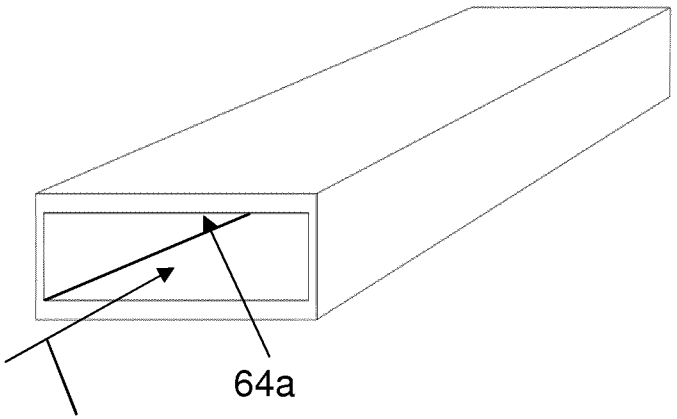
FIGS. 13 to 15 show isometric views of different embodiments of the component shown in FIG. 7.

In the liquid flowing path 61, the liquid may flow along a main direction V (see for example FIG. 10) from the lower portion 3*a* of the tub 3 towards the air chamber 51.

Preferably, the main direction V is set along a horizontal direction which is the normal proceeding direction of a liquid on a horizontal surface.

More preferably, the main direction V is set along a direction which substantially parallel to a supporting plane F, typically a floor, on which the washing machine 1 rests when positioned in its working position.

The detection outlet 60 is preferably cylindrically shaped; in this case, therefore, any section of the detection outlet 60 taken in a plane perpendicular to the main direction V is preferably circular.

According to the invention, the lower part 52 of the air chamber 51 which defines the liquid flowing path 61 is opportunely shaped so as to define a rectilinear (or flat) portion 64*a*.

Preferably, in a mounted configuration, with the air chamber 51 fixed to the washing tub 3 and with the laundry washing machine 1 positioned in its working position, typically resting on the floor F, the lower part 52 of the air chamber 51 which defines the liquid flowing path 61 is opportunely shaped so that the upper part of the liquid flowing path 61 comprises a rectilinear (or flat) portion in a plane perpendicular to the main direction V. Preferably the rectilinear (or flat) portion is positioned in such a way to be substantially horizontal when the machine is in its working position.

In the preferred embodiment here described, the lower part 52 of the air chamber 51 comprises a connecting portion 62 which engages with the detection outlet 60.

More preferably the connecting portion 62 is cylindrically shaped. A gasket 81 is advantageously interposed between the connecting portion 62 and the detection outlet 60 in order to guarantee a tight connection.

The lower part 52 of the air chamber 51 more preferably comprises a shaped tubular duct 63 extending along the main direction V. The tubular duct 63 preferably comprises an upper planar surface 64. The planar surface 64 defines, in a plane perpendicular to the main direction V, a correspondent rectilinear (or flat) portion 64*a*, as better visible in FIGS. 6, 9, 11 and 12.

Figure 12:
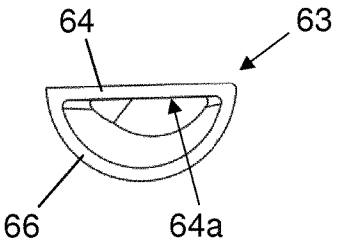
FIG. 12 shows a sectional view taken along line XII-XII of FIG. 10.
Figure 8:
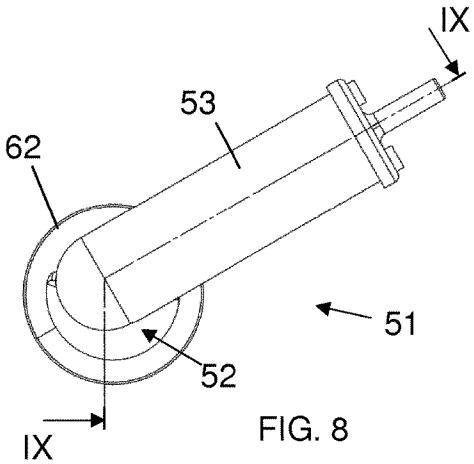
FIG. 8 shows a front plan view of the component of FIG. 7.
Figure 11:
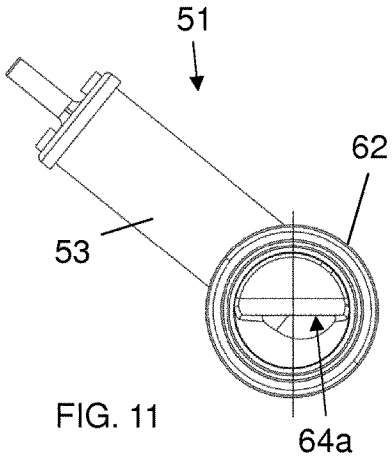
FIG. 11 shows a lateral plan view of the component shown in FIG. 10.
Figure 7:
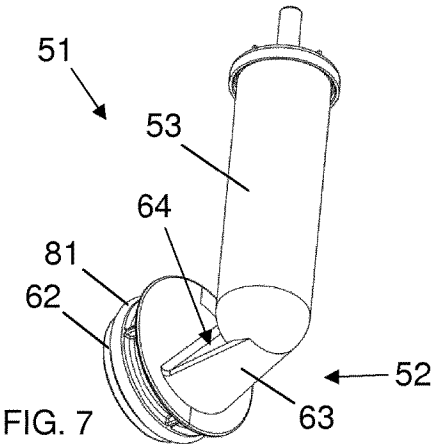
FIG. 7 shows one of the components illustrated in FIG. 5 isolated from the rest.

In the preferred embodiment here described, therefore, in a plane perpendicular to the main direction V, the shaped tubular duct 63 comprises a circular portion 66 and a chord 64*a*, as visible in FIG. 12.

The rectilinear (or flat) portion 64*a*, furthermore, is horizontally displaced with respect to the floor F and defines the upper part of the liquid flowing path 61.

The liquid from the tub 3 flows through the liquid flowing path 61 along the main direction V and reaches the air chamber 51.

When the liquid rises in the tub 3, a corresponding liquid column is also created in the air chamber 51. The liquid column applies a pressure to the air volume enclosed thereabove in the air chamber 51 and inside the conduit 54. Said pressure is then sensed by the pressure sensor 50 connected to the conduit 54.

The pressure sensor 50 starts detecting a pressure only when the liquid flowing path 61 is completely obstructed by the liquid flowing from the washing tub 3 towards the air chamber 51.

According to the invention, the pressure sensor 50 starts detecting a pressure when the liquid flowing in the liquid flowing path 61 reaches a switching point level. In particular, the pressure sensor 50 starts detecting a pressure when the liquid flowing in the liquid flowing path 61 reaches the upper part of liquid flowing path 61, i.e. the rectilinear (or flat) portion 64*a*. When the liquid 61 reaches the rectilinear (or flat) portion 64*a*, in fact, the liquid flowing path 61 is completely obstructed. Actually, the pressure sensor 51 switches from an OFF state, where the pressure corresponds to the atmospheric pressure, to an ON state, where the pressure changes according to the liquid level inside the tub 3.

The transition from the OFF state to the ON state requires an amount of liquid which involves the entire rectilinear (or flat) portion 64*a*. Advantageously, rapid switching ON and OFF as the liquid level varies around the switching point level is prevented.

In the known technique, on the contrary, the transition from the ON state to the OFF state, and vice-versa, takes place substantially in correspondence of a point, i.e. the upper part of a circumference. This inevitably causes instability when the liquid level varies around the switching point level.

The provision of said rectilinear (or flat) portion 64*a*, therefore, enhances the liquid level detection accuracy and stability of the level sensing device 19 compared to the known techniques.

A good stability, or prevention of rapid switching ON and OFF of the pressure sensor, in turn avoids wrong management of the washing cycle. This also increases reliability of the machine and its lifetime.

Furthermore, the switching point level may correspond to a low level of the liquid in the washing tub 3, usually a level where the heater device 18 is placed. A wrong detection of such low level could determine the wrong activation of the heater device while it is not immersed in the liquid. This may cause its damaging.

The present invention advantageously prevents such situation.

It should be noted that the more the extent of the rectilinear (or flat) portion is, the more the above described effect is.

Accordingly, in the preferred embodiment here described the rectilinear (or flat) portion advantageously corresponds substantially to the diameter of the circular section of the tubular duct 63.

Figure 15:
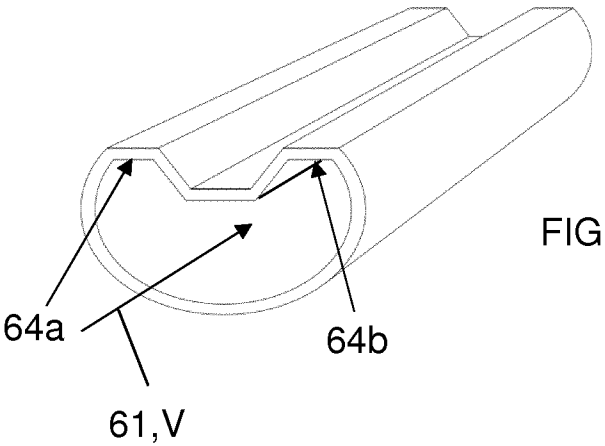
Figure 13:
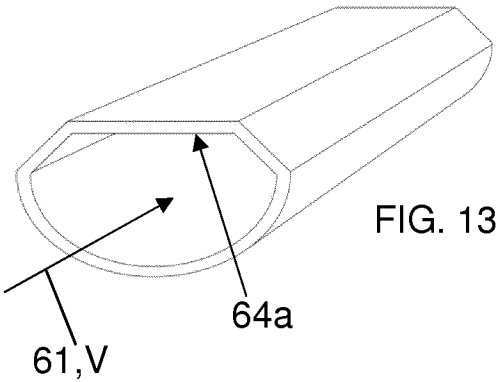
Figure 18:
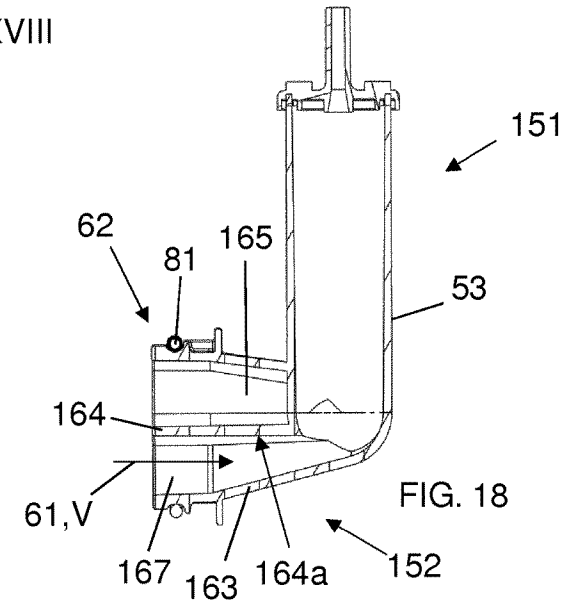
FIG. 18 shows a sectional view taken along line XVIII-XVIII of FIG. 17.
Figure 21:
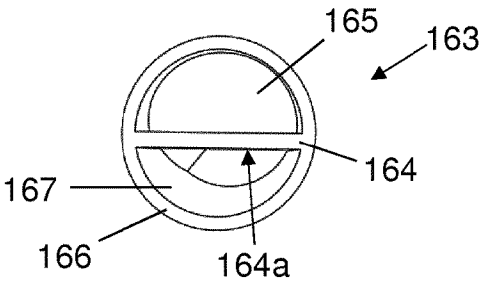
FIG. 21 shows a sectional view taken along line XXI-XXI of FIG. 19.
Figure 17:
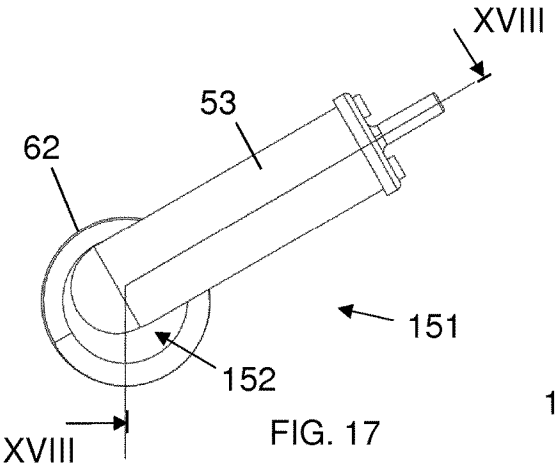
FIG. 17 shows a front plan view of the component of FIG. 16.
Figure 20:
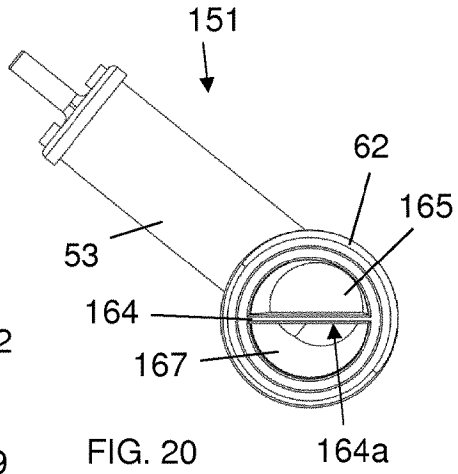
FIG. 20 shows a lateral plan view of the component of FIG. 19.
Figure 16:
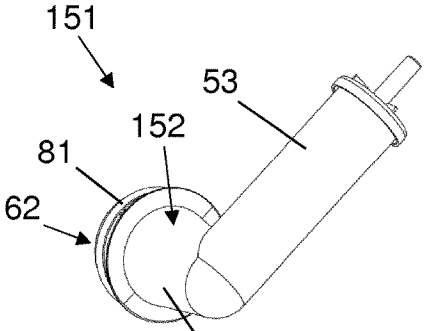
FIG. 16 shows the component shown of FIG. 7 carried out according to a further embodiment of the invention.
Figure 19:
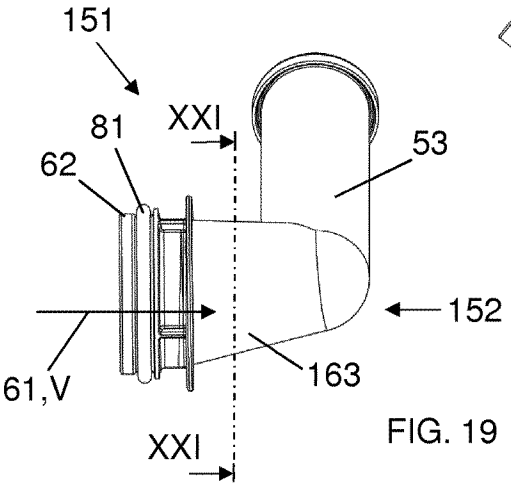
FIG. 19 shows a lateral plan view of the component of FIG. 16.

It should be noted that advantages of the present invention may be obtained by any air chamber comprising a tubular shaped portion having an upper rectilinear (or flat) portion, aside from the shape of tubular portion itself. In figures from 13 to 15, different embodiments of such tubular shaped portion are illustrated. All the illustrated tubular portions have, in fact, at least an upper rectilinear (or flat) portion 64*a*, 64*b*. In particular, in the embodiment illustrated in FIG. 15, the tubular portion has two rectilinear (or flat) portions 64*a* e 64*b* which are aligned along a same axis. Both the rectilinear (or flat) portions 64*a* and 64*b* are, therefore, at the upper part of the liquid flowing path 61 and together directly affect the switching ON of the pressure sensor.

With reference to Figures from 16 to 21 a construction variant of the air chamber 151 is described.

This air chamber 151 differs from the above described air chamber 51 for the different realization of the lower part 152.

Preferably, the lower part 152 comprises a connecting portion 62 which engages with the detection outlet 60. More preferably, the connecting portion 62 is cylindrically shaped. A gasket 81 is advantageously interposable between the connecting portion 62 and the detection outlet 60 in order to guarantee a tight connection.

The lower part 152 of the air chamber 151 then comprises a shaped tubular duct 163 extending along the main direction V. The shaped tubular duct 163 comprises a planar rib 164 defining an upper closed space 165 and a lower space 166.

The upper closed space 165 prevents the liquid from flowing inside the air chamber 151 while the liquid may flow from the washing tub 3 inside the air chamber 151 along the lower space 167. The upper closed space 165 is a dead volume communicating directly with the tub.

This particular construction of the air chamber 151 advantageously simplifies the moulding phase, during its realization, compared to the previously described air chamber 51.

The central planar rib 164 defines, in a plane perpendicular to the main direction V, a correspondent rectilinear (or flat) portion 164*a*.

Therefore, in a plane perpendicular to the main direction V, the shaped tubular duct 163 preferably comprises a circular portion 166 and a chord 164*a*.

Preferably, the planar rib 164 is arranged centrally and the rectilinear (or flat) portion 164*a* substantially corresponds to the diameter of the circular portion 166.

The air chamber 151 with its rectilinear (or flat) portion 164*a* works in the same manner and has the same effects and/or advantages of the air chamber 51 above described with reference the first preferred embodiment of the invention.

In the embodiments above described, the rectilinear (or flat) portion/s according to the invention has/have been realized in the air chamber. In different embodiments, nevertheless, the rectilinear (or flat) portion according to the invention may be realized in the tub. Preferably, the rectilinear (or flat) portion may be realized in the detection outlet of the tub. More preferably, the detection outlet may comprise a circular portion and a chord which defines such a rectilinear (or flat) portion. In particular, the rectilinear (or flat) portion is properly angulated so that when the laundry washing machine is positioned in its working position said rectilinear (or flat) portion is horizontally displaced with respect to the floor F and therefore defines the upper part of the liquid flowing path.

It has thus been shown that the present invention allows all the set objects to be achieved. In particular, it makes it possible to obtain an improved liquid level sensing device arrangement in a laundry washing machine with respect to the machines of the prior art and to increase the detection accuracy compared to machines of known type.

While the present invention has been described with reference to particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A laundry washing machine comprising:

a washing tub external to a rotatable washing drum adapted to receive laundry;

a water supply circuit to supply water into said washing tub;

a washing/rinsing products supplier to supply washing/rinsing products into said washing tub;

a water outlet circuit suitable for withdrawing liquid from said washing tub;

a level sensing device comprising a pressure sensor suitable for determining the liquid level inside said washing tub, said level sensing device further comprising an air chamber connectable to a detection outlet associated to said washing tub;

a liquid flowing path defined between said detection outlet and said air chamber wherein said liquid may flow between said washing tub and said air chamber;

wherein in a mounted configuration, in which said air chamber is associated to said washing tub and said laundry washing machine is positioned in its working position, said path is shaped such that at least a section of said path in a plane perpendicular to a flowing direction of said liquid has the upper part comprising a rectilinear portion, and said path is configured to cause the pressure sensor to start detecting a pressure when the liquid flowing in the liquid flowing path reaches the rectilinear portion to completely obstruct air communication between said washing tub and said pressure sensor.

2. A machine according to claim 1, wherein said section is defined in said air chamber.

3. A machine according to claim 2, wherein said section is defined in a lower part of said air chamber connectable to said detection outlet.

4. A machine according to claim 3, wherein said lower part comprises a tubular portion having at least one upper planar surface, said at least one upper planar surface defining said rectilinear portion.

5. A machine according to claim 3, wherein said lower part comprises a tubular duct comprising at least a planar rib, said planar rib defining said rectilinear portion and in that said planar rib defines an upper closed space and a lower space which allows flowing of liquid.

6. A machine according to claim 1, wherein in said working position said washing machine rests on a substantially horizontal floor.

7. A machine according to claim 1, wherein said flowing direction is a substantially horizontal direction.

8. A machine according to claim 1, wherein said section comprises a lower circular portion and a horizontal chord defining said rectilinear portion.

9. A machine according to claim 1, wherein said detection outlet is realized at a lower portion of said washing tub.

10. A machine according to claim 9, wherein said detection outlet is circularly shaped.

11. A machine according to claim 1, wherein said pressure sensor and said air chamber are connected through a conduit.

12. A machine according to claim 1, wherein said washing tub comprises two complementary hemi-shells reciprocally coupled.

* * * * *